US012398499B2

(12) United States Patent
Berry et al.

(10) Patent No.: US 12,398,499 B2
(45) Date of Patent: Aug. 26, 2025

(54) WASHING MACHINE APPLIANCE LOAD TYPE DETECTION

(71) Applicant: Haier US Appliance Solutions, Inc., Wilmington, DE (US)

(72) Inventors: Adam Berry, Louisville, KY (US); Ryan Ellis Leonard, Louisville, KY (US); Stannard Nathan Phelps, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 257 days.

(21) Appl. No.: 17/836,422

(22) Filed: Jun. 9, 2022

(65) Prior Publication Data

US 2023/0399785 A1 Dec. 14, 2023

(51) Int. Cl.

| | |
|---|---|
| ***D06F 33/48*** | (2020.01) |
| ***D06F 33/32*** | (2020.01) |
| ***D06F 103/24*** | (2020.01) |
| ***D06F 105/48*** | (2020.01) |
| *D06F 103/26* | (2020.01) |

(52) U.S. Cl.

CPC ..... *D06F 33/48* (2020.02); *D06F 33/32* (2020.02); *D06F 2103/24* (2020.02); *D06F 2103/26* (2020.02); *D06F 2105/48* (2020.02)

(58) Field of Classification Search

CPC .. D06F 34/18; D06F 2103/02; D06F 2103/04; D06F 2103/06

See application file for complete search history.

(56) References Cited

U.S. PATENT DOCUMENTS

| | | | | |
|---|---|---|---|---|
| 8,042,211 | B2 | 10/2011 | Stansel et al. | |
| 8,813,288 | B2 | 8/2014 | Bhandwale et al. | |
| 8,932,369 | B2 | 1/2015 | Miller et al. | |
| 9,200,401 | B2 | 12/2015 | Chung et al. | |
| 9,371,607 | B2 | 6/2016 | Pascualena et al. | |
| 9,863,080 | B2 | 1/2018 | Fugal et al. | |
| 9,890,490 | B2 | 2/2018 | Janke et al. | |
| 10,041,202 | B2 | 8/2018 | Sumer et al. | |
| 10,047,470 | B2 | 8/2018 | Kim et al. | |
| 10,301,762 | B2 | 5/2019 | Sumer et al. | |
| 2005/0015890 | A1* | 1/2005 | Kim | D06F 34/18 68/12.02 |

(Continued)

FOREIGN PATENT DOCUMENTS

| | | | | |
|---|---|---|---|---|
| CN | 112779726 A | * | 5/2021 | D06F 34/18 |
| CN | 113005709 A | * | 6/2021 | D06F 33/32 |

(Continued)

*Primary Examiner* — Omair Chaudhri

(74) *Attorney, Agent, or Firm* — Dority & Manning, P.A.

(57) ABSTRACT

A washing machine appliance and methods of operating a washing machine appliance are provided. The washing machine appliance includes a tub and a rotatable basket within the tub. A volume of water is flows into the tub, causing a load of articles in the basket to be wetted. A first weight of the load of articles is measured during an initial spin operation after flowing the volume of water into the wash tub. A water extraction operation is performed after measuring the first weight of the load of articles. A second weight of the load of articles is measured after the water extraction operation. A load type of the load of articles is determined based on the first weight and the second weight.

12 Claims, 3 Drawing Sheets

(56) References Cited

U.S. PATENT DOCUMENTS

| | | | | |
|---|---|---|---|---|
| 2008/0178398 | A1 | 7/2008 | Darby et al. | |
| 2011/0126359 | A1* | 6/2011 | Kim | D06F 35/006 68/12.01 |
| 2014/0082959 | A1* | 3/2014 | Oh | D06F 33/40 34/319 |
| 2017/0350067 | A1* | 12/2017 | Choi | D06F 58/10 |
| 2018/0171533 | A1* | 6/2018 | Lee | D06F 39/14 |
| 2020/0040509 | A1* | 2/2020 | Shinohara | D06F 33/48 |
| 2020/0087829 | A1* | 3/2020 | Kim | D06F 34/18 |
| 2020/0109504 | A1* | 4/2020 | Im | D06F 34/18 |
| 2021/0108350 | A1* | 4/2021 | Kwon | D06F 33/40 |
| 2022/0372687 | A1* | 11/2022 | Park | D06F 33/32 |

FOREIGN PATENT DOCUMENTS

| | | | | |
|---|---|---|---|---|
| CN | 113818200 | A | * | 12/2021 |
| KR | 20080102611 | A | * | 11/2008 |
| WO | WO2014191248 | A1 | | 12/2014 |
| WO | WO2020050621 | A1 | | 3/2020 |

* cited by examiner

WASHING MACHINE APPLIANCE LOAD TYPE DETECTION

FIELD OF THE INVENTION

The present subject matter relates generally to washing machine appliances and methods for operating washing machine appliances, and more particularly to systems and methods for detecting a non-shedding load of articles in such appliances.

BACKGROUND OF THE INVENTION

Washing machine appliances generally include a tub for containing washing fluid, e.g., water, detergent, and/or bleach, during operation of such washing machine appliances. A basket is rotatably mounted within the tub and defines a wash chamber for receipt of articles for washing. During operation of such washing machine appliances, washing fluid is directed into the tub and onto articles within the wash chamber of the basket. The basket can rotate at various speeds to agitate articles within the wash chamber in the washing fluid, to wring washing fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A concern during operation of washing machine appliances is the balance of the basket and contents thereof, e.g., a load of articles and wash liquid, during operation. For example, the articles and wash liquid within the basket may not be equally weighted about a central axis of the basket and tub. Accordingly, when the basket rotates, in particular during a spin cycle, the imbalance in weight may cause the basket to be out-of-balance within the tub, such that the axis of rotation does not align with the central axis of the basket or tub. Such out-of-balance issues during rotation of the basket can cause excessive noise, vibration or motion, or other undesired conditions.

Further, a type of the load of articles, e.g., a material type and the absorbency of the material of the articles, may influence the behavior of the articles and wash liquid during the spin cycle. In particular, when the load includes one or more non-shedding articles, e.g., articles which are waterproof or very low water absorbency, wash liquid may be retained within the basket up to a certain rotational speed (such as entrapped within folds of a non-shedding article) and then, as the rotation accelerates, the wash liquid may be rapidly displaced within or from the basket, causing a sudden shift in the center of mass of the contents of the basket. Such shifting of the center of mass may result in an increased likelihood of an out-of-balance condition.

Accordingly, a laundry appliance having improved features for determining whether a load of articles therein includes non-shedding articles would be desired.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The washing machine appliance includes a wash tub mounted within the washing machine appliance and a basket rotatably mounted within the wash tub. The method includes flowing a volume of water into the wash tub of the washing machine appliance, such that a load of articles in the basket are wetted. The method also includes measuring a first weight of the load of articles during an initial spin operation after flowing the volume of water into the wash tub. The method further includes performing a water extraction operation after measuring the first weight of the load of articles and measuring a second weight of the load of articles after the water extraction operation. The method also includes determining a load type of the load of articles based on the first weight and the second weight.

In another aspect of the present disclosure, a washing machine appliance is provided. The washing machine appliance includes a wash tub mounted within the washing machine appliance and a basket rotatably mounted within the wash tub. The washing machine appliance also includes a controller. The controller is configured for flowing a volume of water into the wash tub of the washing machine appliance, such that a load of articles in the basket are wetted. The controller is also configured for measuring a first weight of the load of articles during an initial spin operation after flowing the volume of water into the wash tub. The controller is further configured for performing a water extraction operation after measuring the first weight of the load of articles and measuring a second weight of the load of articles after the water extraction operation. The controller is also configured for determining a load type of the load of articles based on the first weight and the second weight.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
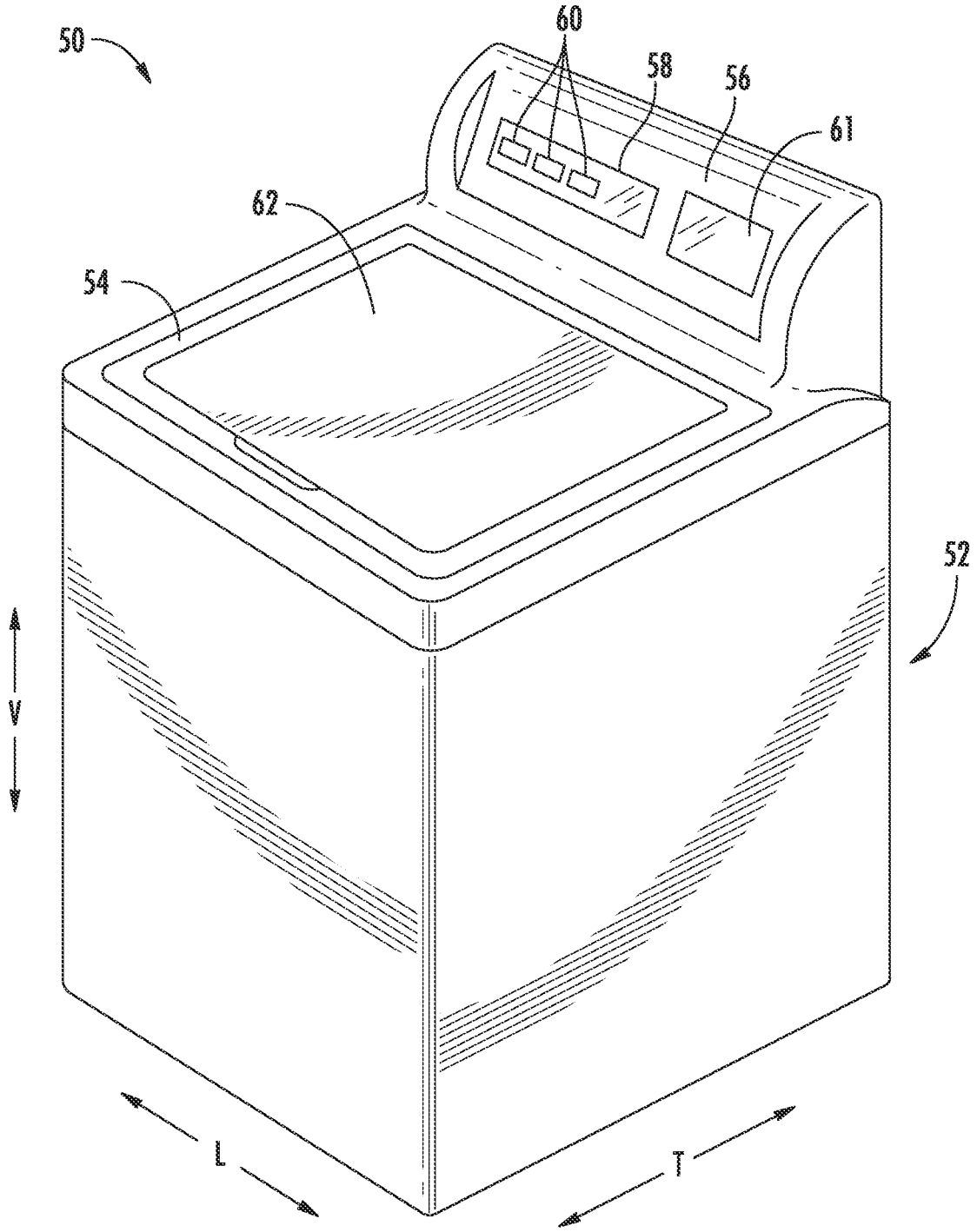
FIG. 1 provides a perspective view of a washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As illustrated, washing machine appliance 50 generally defines a vertical direction V, a lateral direction L, and a transverse direction T, each of which is mutually perpendicular, such that an orthogonal coordinate system is generally defined. As may be seen in FIG. 1, washing machine appliance 50 includes a cabinet 52 and a cover 54. A backsplash 56 extends from cover 54, and a control panel 58 including a plurality of input selectors is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
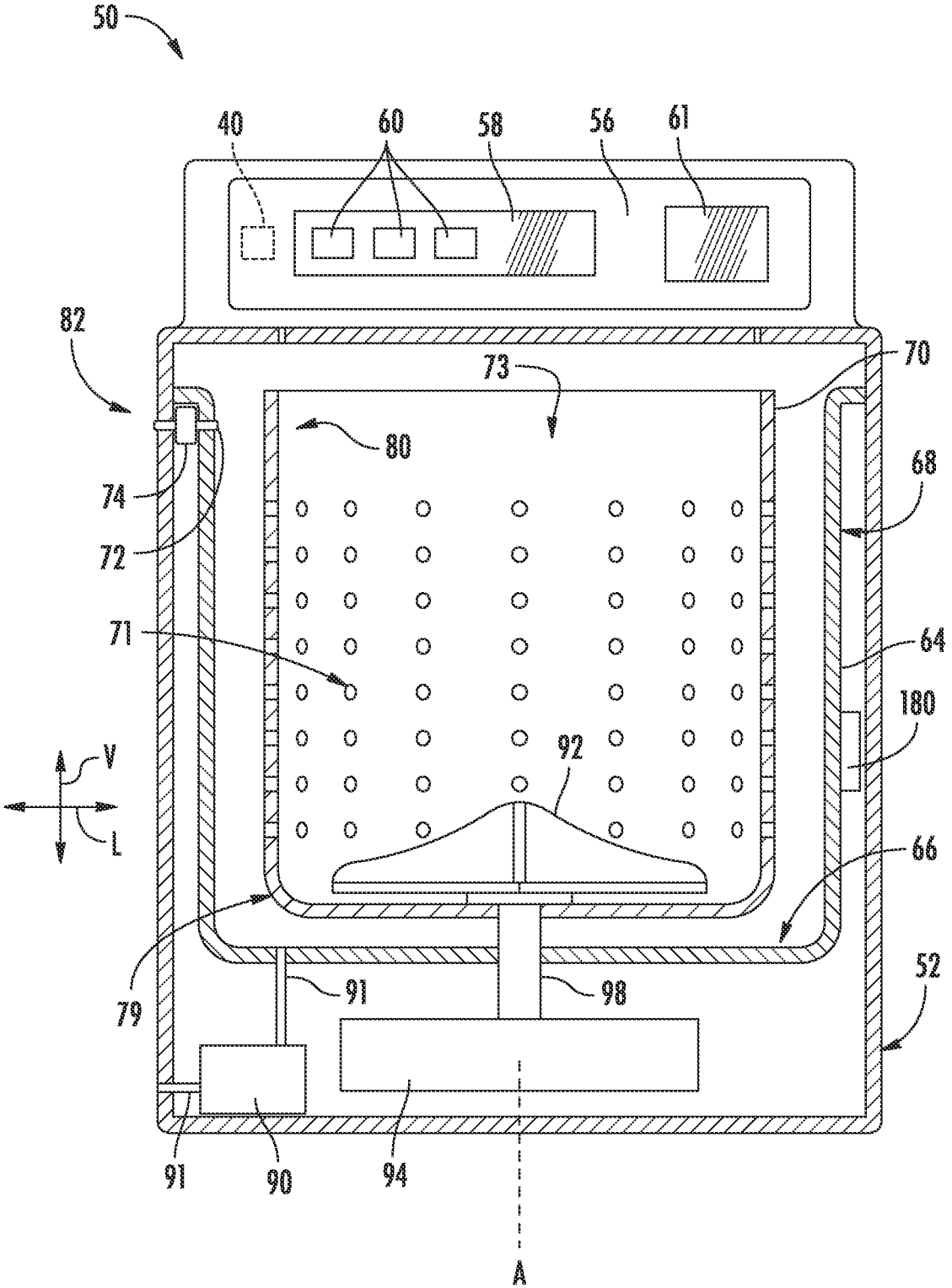
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about an axis of rotation A which, in the illustrated embodiment of FIGS. 1 and 2, is generally parallel to the vertical direction V. Thus, washing machine appliance 50 may be referred to as a vertical axis washing machine appliance. Wash basket 70 defines a wash chamber 73 for receipt of articles for washing and extends, e.g., vertically, between a bottom portion 79 and a top portion Wash basket 70 includes a plurality of perforations 71 therein to facilitate fluid communication between an interior of wash basket 70 and wash tub 64.

A spout 72 is configured for directing a flow of fluid into wash tub 64. In particular, spout 72 may be positioned at or adjacent top portion 80 of wash basket 70. Spout 72 may be in fluid communication with a water supply (not shown) in order to direct fluid (e.g., clean water) into wash tub 64 and/or onto articles within wash chamber 73 of wash basket 70. A valve 74 regulates the flow of fluid through spout 72. For example, valve 74 can selectively adjust to a closed position in order to terminate or obstruct the flow of fluid through spout 72. A pump assembly 90 (shown schematically in FIG. 2) is located beneath tub 64 and wash basket 70 for gravity assisted flow from wash tub 64. Pump 90 may be positioned along or in operative communication with a drain line 91 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 91.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about axis of rotation A. Wash basket 70 and agitation element 92 are driven by a pancake motor 94. As motor output shaft 98 is rotated, wash basket 70 and agitation element 92 are operated for rotatable movement within wash tub 64, e.g., about the axis of rotation A. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 40 that is operatively coupled to the user interface input located on washing machine backsplash 56 for user manipulation to select washing machine cycles and features. In response to user manipulation of the user interface input, controller 40 operates the various components of washing machine appliance 50 to execute selected machine cycles and features.

Controller 40 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 40 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 40 via one or more signal lines or shared communication busses. In particular, controller 40 may be communicatively coupled with one or more sensors, e.g., a temperature sensor, pressure sensor, etc., and/or measurement devices, such as measurement device 180 illustrated in FIG. 2.

In an illustrative embodiment, laundry items are loaded into wash chamber 73 of wash basket 70, and washing operation is initiated through operator manipulation of control input selectors 60. Wash tub 64 is filled with water and mixed with detergent to form a wash fluid. Valve 74 can be opened to initiate a flow of water into wash tub 64 via spout 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 is moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
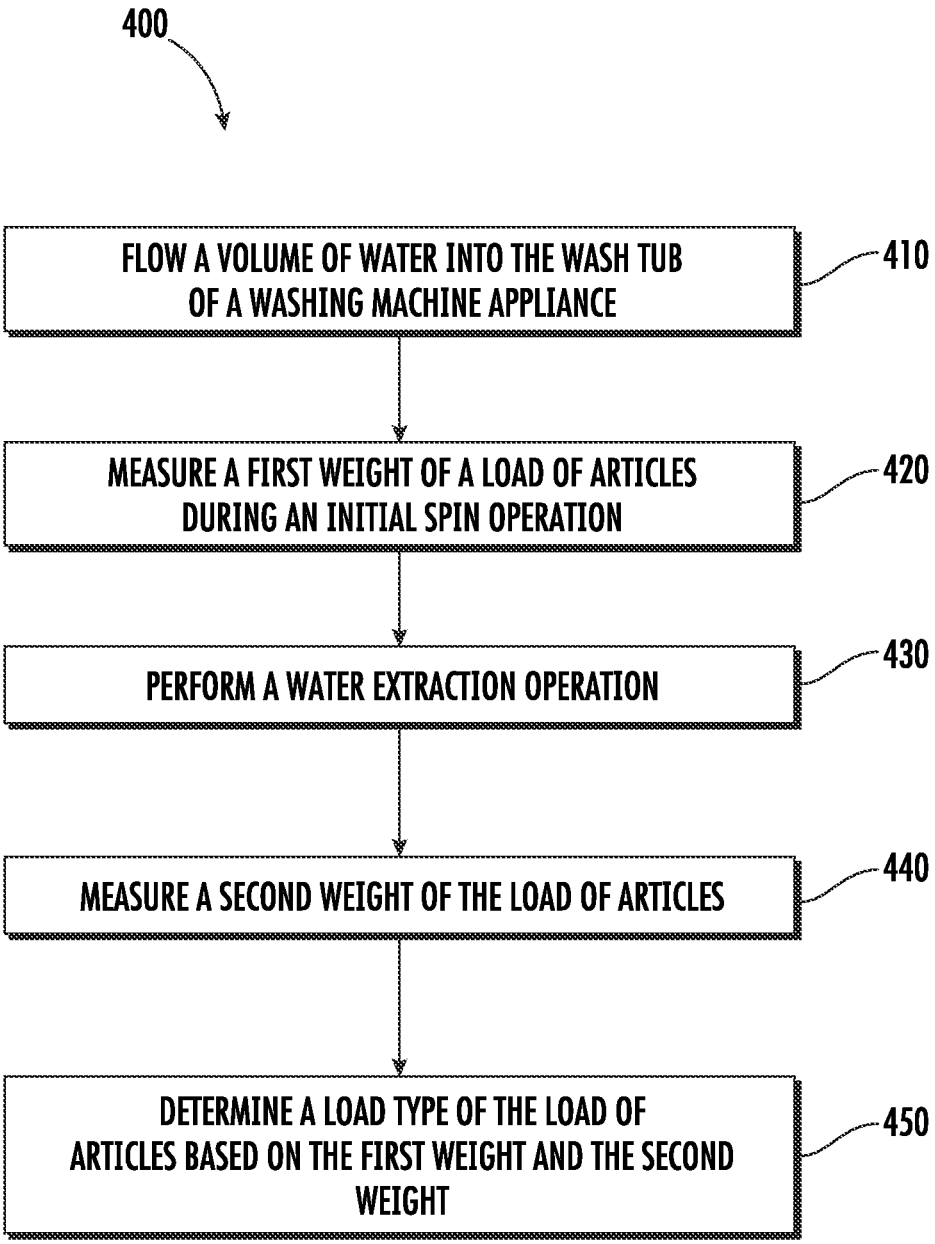
FIG. 3 provides a flow chart illustrating a method for operating a washing machine appliance in accordance with one or more exemplary embodiments of the present disclosure.

Turning now to FIG. 3, embodiments of the present disclosure may also include methods of operating a washing machine appliance, such as the example method 400 illustrated in FIG. 3. Such methods may be used with any suitable washing machine appliance, such as washing machine appliance 50, as described above.

For example, as mentioned above, the washing machine appliance 50 may include a controller 40 and the controller 40 may be operable for, e.g., configured for, performing some or all of the methods and/or steps thereof described herein. For example, one or more method steps may be embodied as an algorithm or program stored in a memory of the controller 40 and executed by the controller 40 in response to a user input such as a selection of a wash operation or rinse operation, etc., of the washing machine appliance 50.

As illustrated in FIG. 3, in some embodiments, the method 400 may include a step 410 of flowing a volume of water into the wash tub of the washing machine appliance, such as into the wash tub and/or a wash basket mounted therein. As a result of flowing the volume of water into the wash tub, a load of articles in the basket may be wetted. Flowing the volume of water may include, for example, opening a valve, e.g., actuating a valve to an open position, such as valve 74 as described above. For example, the valve may be a solenoid valve or other electronically actuated valve in operative communication with a controller of the washing machine appliance, such that flowing the volume of water may include actuating, by the controller, the valve to permit the volume of water to flow into the wash tub.

Method 400 may be a portion of an overall cycle of the washing machine appliance, such as the volume of water flowed into the wash tub at step 410 may be a rinse volume, e.g., a final rinse volume at the end of a rinse operation within the overall cycle, and method 400 may be performed after the rinse operation and before a spin operation. For example, method 400 may be used to determine applicable operating parameters for a remaining or subsequent portion of the overall cycle, such as limiting, e.g., reducing, a final spin speed in the spin operation, among other possible operating parameters which may be determined or adjusted based on the outcome of the method 400.

Still referring to FIG. 3, method 400 may also include measuring a first weight of the load of articles during an initial spin operation after flowing the volume of water into the wash tub, e.g., as indicated at 420 in FIG. 3. The initial spin operation may be performed while the load of articles is still wet from the volume of water such that the load of articles may be at its most water-saturated state throughout the overall cycle of the washing machine appliance when the first weight is measured, e.g., the first weight may be a wet weight or a saturated weight of the load of articles. In some embodiments, the initial spin may be a ramp-up phase, such as a first or initial phase after a rinse operation or wash operation, wherein the basket is rotated at steadily increasing speeds up to a water extraction speed. In such embodiments, the ramp-up phase may end before the basket reaches the extraction speed, e.g., the ramp-up phase may be an initial period wherein the basket, and a motor coupled to the basket whereby the motor is operable to drive the rotation of the basket, starts from a zero speed and overcomes forces which tend to keep the basket stationary, such as inertia and friction, in order to build up rotational speed of the basket and approach the extraction speed. Moreover, those of ordinary skill in the art will recognize that there may be a range of effective water extraction speeds, such as a range of rotational speeds of the basket which may be effective to centrifugally extract at least a portion of the moisture from the basket and/or articles therein while rotating the basket. Thus, for example, methods of operating the washing machine appliance may include multiple differing extraction speeds, such as in an inclusive range from a minimum water extraction speed to a maximum water extraction speed. In the initial spin or ramp-up phase described herein, the basket may be rotated at speeds below the maximum water extraction speed, such as at an intermediate extraction speed that is greater than the minimum water extraction speed and less than the maximum water extraction speed, or such as at or about the minimum water extraction speed, or such as at speeds less than the minimum water extraction speed. In some embodiments, the initial spin operation may be performed immediately after flowing the volume of water into the wash tub, such as without any intervening spin operations or without any intervening water removal or extraction operations, e.g., such that the load of articles in the basket are still at a most water-saturated state of the overall washing machine cycle during the initial spin operation.

As illustrated in FIG. 3, in some embodiments, method 400 may also include performing a water extraction operation after measuring the first weight of the load of articles, e.g., as indicated at 430. The water extraction operation generally includes rotating the basket at higher speeds than the initial spin operation which is described above. For example, the water extraction operation may, in some embodiments, include operating the motor of the washing machine appliance to rotate the basket at an extraction speed greater than the second speed and less than a terminal spin speed. The water extraction operation may also include rotating the basket at a speed that is less than a full terminal speed of the overall cycle of the washing machine appliance, e.g., the full terminal speed may be the default, e.g., predetermined or pre-programmed, maximum speed for a spin operation of the overall cycle, such as a largest parametric value for a spin speed operating parameter stored in a memory of a controller of the washing machine appliance, or the largest parametric value may also or instead be stored remotely, e.g., in the cloud or other distributed computing environment. For example, the water extraction operation may include rotating the basket at a speed greater than the minimum water extraction speed and less than the maximum water extraction speed and/or less than the full terminal speed. In particular, where method 400 may be used to detect a potential out-of-balance condition or a load, such as a non-shedding load, which may be more susceptible to an out-of-balance condition, the water extraction operation at step 430 may include speeds which are limited, e.g., less than maximum water extraction speed, in order to reduce the likelihood of an out-of-balance condition during the method 400.

Still referring to FIG. 3, the method 400 may also include a step 440 of measuring a second weight of the load of articles. For example, the second weight may be measured after the water extraction operation, e.g., the second weight may be a dry weight or damp weight, wherein the load of articles is, or is expected to be, at a lower moisture content (e.g., a less water-saturated state) as a result of the water extraction operation from step 430.

In some embodiments, method 400 may further include determining a load type of the load of articles based on the first weight and the second weight, e.g., as indicated at 450 in FIG. 3. For example, determining the load type may include determining whether the load is a non-shedding load. For example, where the difference between the first weight and the second weight is relatively small or a ratio of the first weight to the second weight is relatively low, the load may be determined to be a non-shedding load, e.g., the relatively low change in weight and inertia as a result of the water extraction operation may indicate that the load is a non-shedding load. As another example, where the difference between the first weight and the second weight is relatively high or a ratio of the first weight to the second weight is relatively large, the load may be determined to be a shedding load, e.g., the high change in weight and inertia as a result of the water extraction operation in comparison to a non-shedding load may indicate that the load is a shedding load.

In exemplary embodiments where the load is determined to be a non-shedding load, e.g., where determining the load type of the load of articles includes determining the load of articles is a non-shedding load, the method 400 may further include one or more remedial actions in order to reduce the likelihood of an out-of-balance condition occurring while washing the non-shedding load. For example, in some embodiments, such remedial actions may include limiting a final spin speed in response to determining the load of articles is a non-shedding load, such as performing a spin operation, e.g., wherein the terminal speed of the spin operation is less than the full terminal speed and/or less than a maximum water extraction speed. As another example, such remedial actions may also or instead include performing a load redistribution operation in response to determining the load of articles is a non-shedding load. The load redistribution operation may include rotating the basket and/or an agitator therein, such as oscillating one or both of the basket and agitator back and forth, at a tumble speed (e.g., less than water extraction speed, as will be understood by those of ordinary skill in the art), and may also include draining the wash tub and re-filling the wash tub with a second volume of water. For example, the load redistribution operation may free any water trapped in the folds of the non-shedding articles and promote balancing the load.

In some embodiments, the weights may be measured based on power delivered to/consumed by a motor of the washing machine appliance while the motor is operated to rotate the basket of the washing machine appliance. For example, measuring the first weight of the load of articles may include operating a motor of the washing machine appliance to rotate the basket at a first speed, operating the motor to accelerate the basket from the first speed to a second speed, and determining a power consumption, e.g., a first power consumption, of the motor while operating the motor to accelerate the basket, and measuring the second weight of the load of articles may also include operating the motor of the washing machine appliance to rotate the basket at the first speed, operating the motor to accelerate the basket from the first speed to the second speed, and determining a power consumption, e.g., a second power consumption, of the motor while operating the motor to accelerate the basket.

Further, in embodiments where the weights are measured based on power, because the load type is determined based on the first weight and the second weight, then the load type may also be based on the measured powers. For example, in some embodiments where determining the load type includes determining whether the load is a non-shedding load, such determination may include calculating a non-shedding load score based on a first power delivered to the motor of the washing machine appliance while measuring the first weight of the load of articles and a second power delivered to the motor of the washing machine appliance while measuring the second weight of the load of articles. In some embodiments, determining the load type of the load of articles may be based a ratio of the first weight to the second weight, such as the non-shedding load score may be based, at least in part, on the ratio of the first weight to the second weight.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance comprising a wash tub mounted within the washing machine appliance and a basket rotatably mounted within the wash tub, the method comprising:

flowing a volume of water into the wash tub of the washing machine appliance, whereby a load of articles in the basket are wetted, wherein the volume of water is a final rinse volume at the end of a rinse operation within an overall cycle of the washing machine appliance;

measuring a first weight of the load of articles during an initial spin operation after flowing the volume of water into the wash tub without any intervening spin operations, wherein the initial spin operation is a ramp-up phase comprising operating a motor of the washing machine appliance to rotate the basket starting from a zero speed to a first speed greater than zero and operating the motor to accelerate the basket from the first speed to a second speed, wherein the second speed is a minimum water extraction speed, wherein measuring the first weight comprises determining a first power consumption of the motor while operating the motor to accelerate the basket from the first speed to the minimum water extraction speed;

performing a water extraction operation after measuring the first weight of the load of articles, wherein the water extraction operation comprises operating the motor of the washing machine appliance to rotate the basket at an intermediate extraction speed greater than the minimum water extraction speed and less than a terminal spin speed;

measuring a second weight of the load of articles after the water extraction operation, wherein measuring the second weight of the load of articles comprises decelerating the basket from the intermediate extraction speed, operating the motor of the washing machine appliance to rotate the basket at the first speed, operating the motor to accelerate the basket from the first speed to the minimum water extraction speed, and determining a second power consumption of the motor while operating the motor to accelerate the basket from the first speed to the minimum water extraction speed; and determining a load type of the load of articles based on the first weight and the second weight.

2. The method of claim 1, wherein determining the load type of the load of articles comprises determining the load of articles is a non-shedding load.

3. The method of claim 2, further comprising limiting a final spin speed in response to determining the load of articles is a non-shedding load.

4. The method of claim 2, further comprising performing a load redistribution operation in response to determining the load of articles is a non-shedding load.

5. The method of claim 2, wherein determining the load of articles is the non-shedding load comprises calculating a non-shedding load score based on the first weight of the load of articles and the second weight of the load of articles.

6. The method of claim 1, wherein determining the load type of the load of articles comprises determining the load type of the load of articles based on a ratio of the first weight to the second weight.

7. A washing machine appliance, comprising:

a wash tub mounted within the washing machine appliance;

a basket rotatably mounted within the wash tub; and a controller, the controller configured for:

flowing a volume of water into the wash tub of the washing machine appliance, whereby a load of articles in the basket are wetted, wherein the volume of water is a final rinse volume at the end of a rinse operation within an overall cycle of the washing machine appliance;

measuring a first weight of the load of articles during an initial spin operation after flowing the volume of water into the wash tub without any intervening spin operations, wherein the initial spin operation is a ramp-up phase comprising operating a motor of the washing machine appliance to rotate the basket starting from a zero speed to a first speed greater than zero and operating the motor to accelerate the basket from the first speed to a second speed, wherein the second speed is a minimum water extraction speed, wherein measuring the first weight comprises determining a first power consumption of the motor while operating the motor to accelerate the basket from the first speed to the minimum water extraction speed;

performing a water extraction operation after measuring the first weight of the load of articles, wherein the water extraction operation comprises operating the motor of the washing machine appliance to rotate the basket at an intermediate extraction speed greater than the minimum water extraction speed and less than a terminal spin speed;

measuring a second weight of the load of articles after the water extraction operation, wherein measuring the second weight of the load of articles comprises decelerating the basket from the intermediate extraction speed, operating the motor of the washing machine appliance to rotate the basket at the first speed, operating the motor to accelerate the basket from the first speed to the minimum water extraction speed, and determining a second power consumption of the motor while operating the motor to accelerate the basket from the first speed to the minimum water extraction speed; and determining a load type of the load of articles based on the first weight and the second weight.

8. The washing machine appliance of claim 7, wherein determining the load type of the load of articles comprises determining the load of articles is a non-shedding load.

9. The washing machine appliance of claim 8, wherein the controller is further configured for limiting a final spin speed in response to determining the load of articles is a non-shedding load.

10. The washing machine appliance of claim 8, wherein the controller is further configured for performing a load redistribution operation in response to determining the load of articles is a non-shedding load.

11. The washing machine appliance of claim 8, wherein determining the load of articles is the non-shedding load comprises calculating a non-shedding load score based the first weight of the load of articles and the second weight of the load of articles.

12. The washing machine appliance of claim 7, wherein determining the load type of the load of articles comprises determining the load type of the load of articles based on a ratio of the first weight to the second weight.

* * * * *